United States Patent [19]

Andrews et al.

[11] 4,105,403

[45] Aug. 8, 1978

[54] KNITTED COTTON FABRIC DURABLY PATTERNED BY DIFFERENTIAL SHRINKAGE

[75] Inventors: Bethlehem K. Andrews, New Orleans; Robert J. Harper, Jr.; Norton A. Cashen, both of Metairie, all of La.

[73] Assignee: The United States of America as represented by the Secretary of Agriculture, Washington, D.C.

[21] Appl. No.: 684,127

[22] Filed: May 7, 1976

[51] Int. Cl.[2] ..... D06Q 1/02

[52] U.S. Cl. ..... 8/115; 8/114; 8/182; 8/184; 8/185; 8/186

[58] Field of Search ..... 8/114, 184, 115, 186, 8/182, 185

[56] References Cited

U.S. PATENT DOCUMENTS

| | | | |
|---|---|---|---|
| 2,202,200 | 5/1940 | Haller et al. | 8/115 |
| 2,776,868 | 1/1957 | Russel et al. | 8/114 |
| 2,899,263 | 8/1959 | Nuessle et al. | 8/114 |
| 3,402,988 | 9/1968 | Reeves et al. | 8/115 |
| 3,467,484 | 9/1969 | Hermes | 8/15 |

*Primary Examiner*—A. Lionel Clingman
*Attorney, Agent, or Firm*—M. Howard Silverstein; David G. McConnell; Salvador J. Cangemi

[57] ABSTRACT

To the surface of knitted cotton fabrics is applied from 20 to 90% wet add-on of crosslinking agent in a novel geometric pattern by any of several techniques including kiss-roll padding, printing, or transferring the solution of crosslinking agent from impregnated material to the surface of the knitted fabric, followed by drying and curing the moist textile at elevated temperatures, and finally by washing the cured fabric to effect differential shrinkage of the fabric in the applied design, which novel shrinkage in the fabric is fixed through the life of the fabric and is stable through subsequent launderings.

1 Claim, 3 Drawing Figures

KNITTED COTTON FABRIC DURABLY PATTERNED BY DIFFERENTIAL SHRINKAGE

Figure 1:
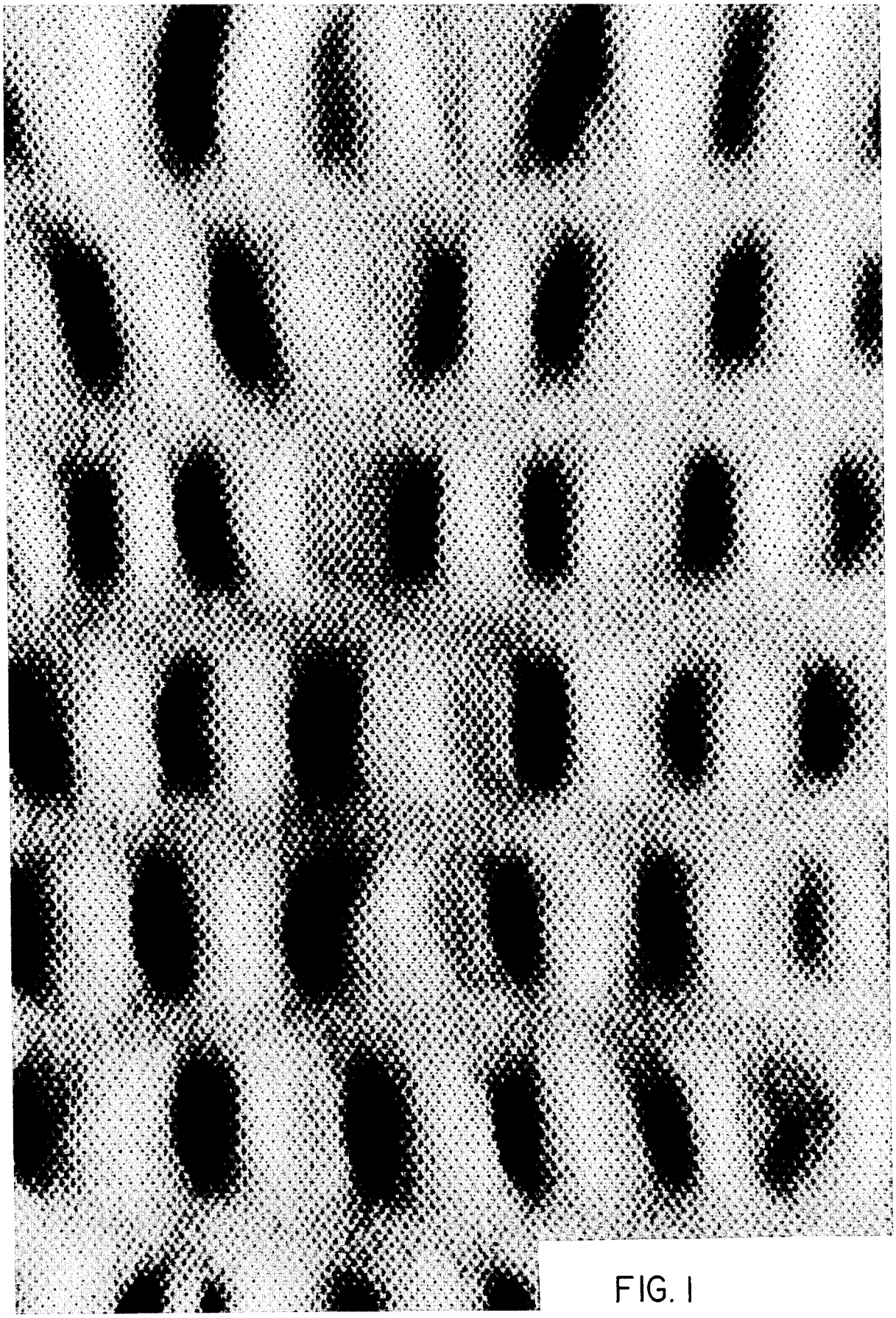
Figure 2:
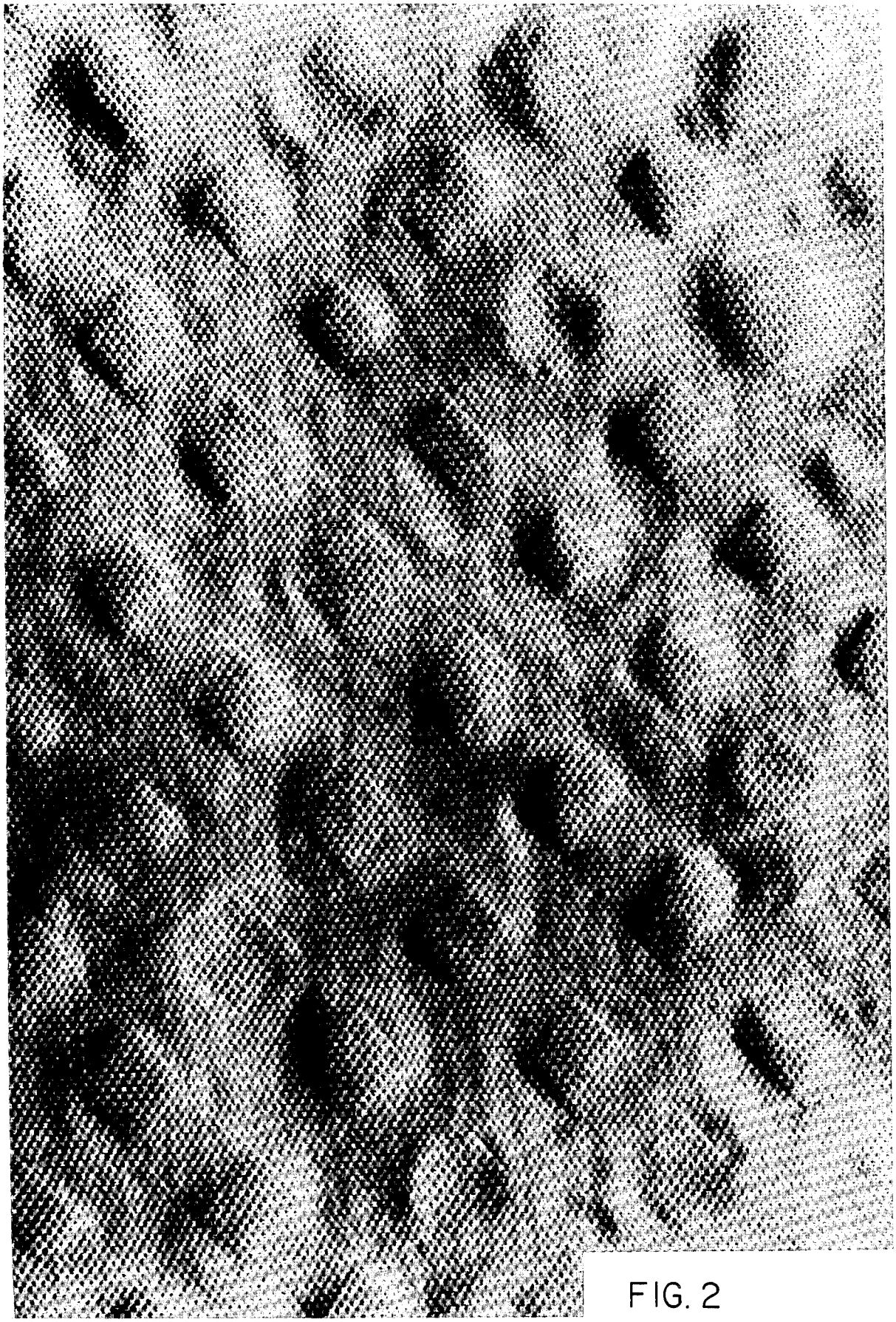
Figure 3:
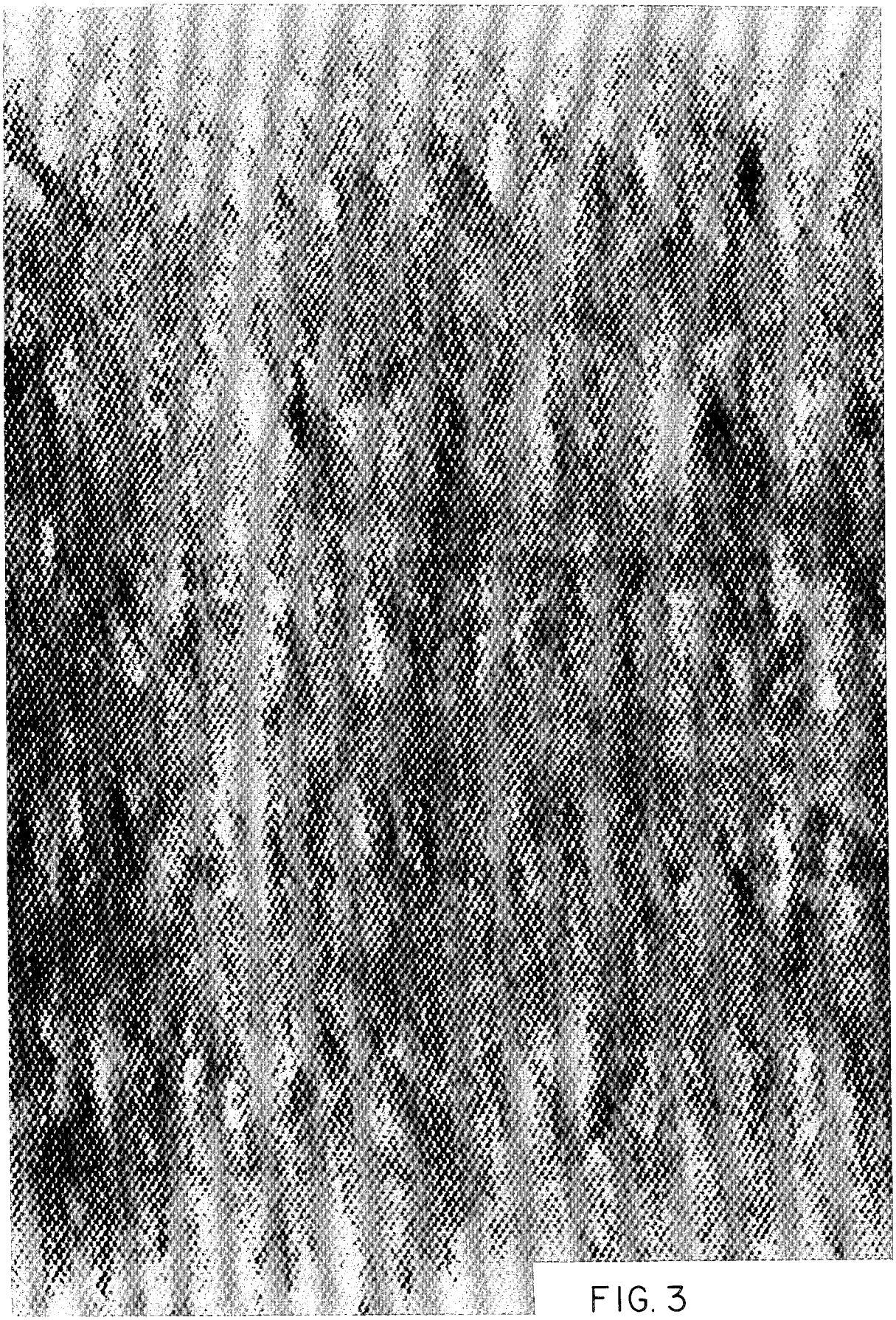

This invention relates to chemical treatments of cotton and other cellulosic knitted fabric (in open width form). More particularly, this invention relates to a process for chemical finishing of cellulose-containing knitted fabrics to effect differential shrinkage throughout the fabric. Specifically this invention provides a method of producing novel shrunk and non-shrunk areas of the fabric in geometric designs which designs are durable throughout the life of the fabric, the novelty comprising two steps, application of a crosslinking agent and catalyst to one side of the fabric only in a geometric design, drying and curing the fabric at elevated temperatures to effect the crosslinking, followed by a washing step that allows the inherent shrinkage of uncrosslinked knitted fabric to produce differential shinkage between the uncrosslinked portion of the fabric and the crosslinked portion of the fabric fixed at near original dimensions to achieve the geometric design.

Field to Which This Invention Relates

When mercerizing caustic comes in contact with a woven fabric, the diameter of the cotton fiber increases and the fiber shrinks longitudinally, causing the fabric to shrink also, if not forcibly maintained at original dimensions. Plisse woven fabric has been produced for many years by utilizing this phenomenon. The woven fabric is mercerized in stripes or designs, soured and rinsed. Wherever the caustic comes in contact with the woven fabric, that portion of the fabric shrinks preferentially, producing a puckered or crinkled final product called plisse.

The Problem

Although plisse woven fabrics are produced by utilization of fabric shrinkage during slack or tensionless mercerization, this effect cannot be utilized in the projection of a patterned knitted fabric through differential shrinkage for the following reasons. First, it is not commercially practical to mercerize knitted cottons in the fabric form because of the difficulty in maintaining proper tension required to prevent overframing of knitted fabric as the swelling forces of mercerization shrink the fabric. Secondly, inherent shrinkage in unfinished (uncrosslinked) fabric is gross (approximately 20%) compared to that in a similar woven fabric (approximately 5%), so that, one or more washings eliminate the differential shrinkage achieved by preferential mercerization of knitted fabric, that is, mercerizing in stripes or designs, and the differential shrinkage effects can only be fixed by a subsequent crosslinking treatment. Therefore, the problem is to produce differential shrinkage in knitted fabric containing cotton or cellulosics such that the design resulting from this differential shrinkage is durable throughout the life of the fabric.

The Prior Art

Knitted fabrics with puckered or textured effects can be produced by stitch patterning during the knitting process or by alternation of coarse and fine yarns in an unpatterned fabric. Fabrics produced by these methods are predominantly of synthetic fibers, and those produced by the latter method actually require synthetic yarns in that portion of the fabric containing the finer yarns. The puckered or textured knitted fabrics that are predominantly of cotton produced by knitting techniques still have the inherent tendency to shrink that do all knitted fabrics containing cotton and would require a subsequent crosslinking process to prevent further shrinkage.

Object of the Invention

The chief objective of the instant invention is to create a process for imparting to knitted fabrics durable differential shrinkage characteristics, similar to those imparted to woven fabrics by mercerizing in stripes, without either the use of mercerizing caustic, or processes that modify the actual knitting of the fabric.

How the Objective is Achieved

We have found that a knitted fabric with differential shrinkage characteristics can be produced by striping or otherwise applying in a geometric design a crosslinking formulation to one side only of a knitted fabric. The crosslinking formulation includes, of necessity, the crosslinking agent and catalyst; surfactants, thickeners, or polymers either for lubricating or handbuilding purposes, can be added without detriment to the process of the instant invention.

Crosslinking agents suitable for use in this invention are the methylolamide group of agents such as dimethylol ethyleneurea or dimethylol dihydroxyethyleneurea. The specific crosslinking agent selected, however, is not integral to the process of the invention and any crosslinking agent which imparts shrinkage resistance to cellulose-containing knitted textiles is suitable for use in the instant invention.

Catalysts suitable for use in this invention are of the latent-acid types and include magnesium chloride hexahydrate and zinc nitrate hexahydrate. Any catalyst that promotes the reaction between crosslinking agent and cellulose, however, is suitable for use in the instant invention.

Although there may be many variables to the instant invention, the instant invention can be described as a process for imparting differential shrinkage characteristics to cellulose-containing fibrous material, the process comprising:

(a) applying to selected areas of the knitted cotton textile by printing, transfer from an impregnated material, kiss-roll padding, or by any other conventional manner to achieve deposition in a geometric design, to a wet add-on (pick-up) of from 20 to 90%, and aqueous solution containing from 3 to 25% of a crosslinking agent and an acid type catalyst, and (b) further processing the textile containing preferentially applied crosslinking agent by the common dry-cure techniques, and (c) washing the cured fabric by common washing procedures to differentially shrink the crosslinked and uncrosslinked portions of the fabric.

The Application Step

A wet add-on of 20 to 90% crosslinking formulation deposited in a pattern or design on one surface of the fabric is achieved by several techniques. One of the techniques that is efective in laboratory applications is:

(a) covering the fabric with water-resistant paper tape in a stripe or novelty design and applying the crosslinking solution to the uncovered portion of the fabric via kiss-roll. In a commercial application, the tape could be omitted and, with an engraved roll attachment to a kiss-roll padder in the desired stripe or design, crosslinking solution could be applied to the fabric preferentially without the necessity of covering part of the fabric with tape.

The Washing Step

The purpose of the washing step is to shrink the fabric in the areas inaccessable to crosslinking solution during the application step. In laboratory trials, the washing was carried out in an ordinary home-type washing machine. Commercially, this step could be performed on an open soaper or washing range.

SUMMARY OF THE INVENTION

In summary, this invention provides a process for imparting, to knitted materials containing a cellulosic component, novel shrunk and non-shrunk areas of the fabric in geometric designs to produce a product that resembles woven plisse. The novel effect of the final product is durable and dimensionally stable throughout the life of the fabric, and the advantages of such durability are well known.

The following examples are provided to illustrate the practice and results of the process of the instant invention and are not in any way intended to limit the scope of the invention. All percentages shown in the examples are percentages by weight of the total solution. Current test methods of the American Association of Textile Chemists and Colorists were used in evaluating fabric shrinkage.

EXAMPLE 1

A single layer of a sample of a 3.07 sq. yd./lb. cotton jersey fabric of 20/1 yarn knitted in a French tuck pattern, measuring 96 in. by 20 in, was striped down the length of the fabric on one side of the fabric only at 1¼ in. intervals with ¾ in. width water resistant paper adhesive tape so that the width of uncovered fabric stripes was ½ in. An aqueous solution containing 20% dimethylol dihydroxyethyleneurea, 6.0% magnesium chloride hexahydrate, 0.1% 29-(isooctylphenoxy) -3,6,9,12,15,18,21,24,27- nonaoxanonacosan - 1 - ol was applied to the taped side of the fabric using a kiss-roll padder equipped with a wiper blade behind the bottom roll. The water-resistant tape was removed and the fabric was dried 70° C for 10 minutes and cured 160° C for 3 minutes. The samples were then washed in a home-type washing machine at the Wash-Wear setting and dried at washed dimensions. Dimensional changes during processing and home-type laundering are shown in Table I.

TABLE I

| Processing Step | Width of Stripe (in.) | | Total Fabric Shinkage(%) | |
|---|---|---|---|---|
| | Crosslinked | Uncrosslinked | Walewise | Coursewise |
| Original | 0.5 | 0.75 | — | — |
| Through Processing | 0.6 | 0.4 | 13.2 | 6.8 |
| After Five Home Launderings | 0.6 | 0.33 | 2.2 | 0.4 |

The data show that a plisse-type knitted fabric is produced by striping the crosslinking solution down the length of the fabric, followed by drying, curing and then washing the fabric. That the plisse effect is produced is indicated by the change is stripe width of the uncrosslinked stripe during processing. The retention of original stripe width through five home launderings, and the appearance of the fabric as seen in Photograph 1, indicates that the plisse effect is durable through home launderings. The negligible change in total fabric shrinkage after five home launderings indicates that the fabric is dimensionally stable.

EXAMPLE 2

A single layer of the cotton jersey mentioned in Example 1 was crossed with water-resistant paper adhesive tape on one side of the fabric only in an equi-sided parallelogram pattern by laying down the tape on the diagonals of the fabric with exposed areas of the fabric having diagonals of ½ in. and 1 in. An aqueous solution, mentioned in Example 1 was applied to the taped side of the fabric using the kiss-roll padding technique mentioned in Example 1. The tape was removed from the fabric, and the fabric dried at 70° C for 10 minutes and cured at 160° C for 3 minutes. The samples were washed and dried as mentioned in Example 1. Dimensional changes during processing and home-type laundering are shown in Table II.

TABLE II

| Processing Step | Width (in.) of | | Total Fabric Shinkage(%) | |
|---|---|---|---|---|
| | Long Diagonal Crosslinked | Stripe Uncrosslinked | Walewise | Coursewise |
| Original | 1.0 | 0.75 | — | — |
| Through Processing | 0.9 | 0.5 | 13.2 | 6.8 |
| After Five Home Launderings | 0.9 | 0.4 | 2.2 | 0.8 |

The data show that a novelty design fabric is produced by application of crosslinking agent in a repeating geometric design down the length of the fabric, followed by drying, curing, and then washing the fabric, and this novelty effect is durable through home launderings, as shown in Photograph 2.

Example 3

A single layer of the cotton jersey mentioned in Example 1 was striped down the length of the fabric on one side of the fabric only with ¾ in. width water-resistant paper adhesive tape so that the width of the uncovered fabric was 1¼ in. The uncovered portion of the sample was saturated with an aqueous mercerizing solution containing 20% sodium hydroxide and 0.1% Seycomerse — 38, using a print roller. The water-resistant tape was removed and the mercerizing solution allowed to remain striped on the fabric for 3 minutes. The sample was then rinsed in running hot water for 5 minutes, soured in an aqueous solution containing 5% acetic acid for 5 minutes, and rinsed in cold running water for 15 minutes. The fabric was dried at rinsed dimensions. Dimensional changes during processing and home-type launderings are shown in Table III.

TABLE III

| Processing Step | Width (in.) of Stripe | | Total Fabric Shinkage(%) | |
|---|---|---|---|---|
| | Mercerized | Unmercerized | Walewise | Coursewise |
| Original | 1.25 | 0.75 | — | — |
| Through Processing | 0.6 | 0.8 | 19.2 | 13.2 |
| After Five Home Launderings | indistinguishable | | 11.5 | 6.1 |

The data show that a greater loss in fabric area is realized in the production of plisse knitted fabric through mercerization than by crosslinking and that the plisse effects so produced are not durable through home launderings, as shown in Photograph 3.

We claim:

1. A process for imparting to knitted cotton textiles the enhancing quality of a novel patterned effect throughout a shrinkage resistant fabric, produced by differential shrinkage in treatment, which process comprises:

(a) applying to selected areas to the surface of a knitted cotton textile, to a wet add-on of about from 20 to 90 weight percent with aqueous solution containing:

(1) a methylol amide crosslinking agent; and (2) an acid catalyst;

(b) drying the moist textile from (a) at a temperature at about 70° C (c) curing the dry textile from (b) at a temperature at about 160° C (d) washing the cured textile from (c); and (e) drying the washed textile from (d), wherein the application is effected by making a portion of the surface of the knitted cotton textile inaccessable to the solution of crosslinking agent by means of water-resistant adhesive tape placed on the fabric in a geometric design and applying the solution of crosslinking agent to the fabric by kiss-roll padding.

* * * * *